US008616690B2

(12) United States Patent
Saito et al.

(10) Patent No.: US 8,616,690 B2
(45) Date of Patent: Dec. 31, 2013

(54) RECORDING APPARATUS

(75) Inventors: Riichi Saito, Fujisawa (JP); Noribumi Koitabashi, Yokohama (JP); Osamu Sato, Takasaki (JP); Nobuyuki Kuwabara, Hachioji (JP)

(73) Assignee: Canon Kabushiki Kaisha, Tokyo (JP)

( * ) Notice: Subject to any disclaimer, the term of this patent is extended or adjusted under 35 U.S.C. 154(b) by 547 days.

(21) Appl. No.: 12/630,664

(22) Filed: Dec. 3, 2009

(65) Prior Publication Data

US 2010/0141722 A1 Jun. 10, 2010

(30) Foreign Application Priority Data

Dec. 5, 2008 (JP) ..... 2008-311230
Oct. 6, 2009 (JP) ..... 2009-232730

(51) Int. Cl.

| | |
|---|---|
| ***B41J 2/19*** | (2006.01) |
| ***B41J 29/38*** | (2006.01) |
| ***B41J 2/175*** | (2006.01) |
| ***B41J 2/18*** | (2006.01) |

(52) U.S. Cl.
USPC ..... 347/92; 347/6; 347/85; 347/89

(58) Field of Classification Search
USPC ..... 347/6, 84, 85, 86, 89, 92
See application file for complete search history.

(56) References Cited

U.S. PATENT DOCUMENTS

| | | | | |
|---|---|---|---|---|
| 5,481,284 | A * | 1/1996 | Kitahara et al. | 347/89 |
| 6,213,601 | B1 * | 4/2001 | Akuzawa et al. | 347/89 |
| 2006/0290752 | A1 * | 12/2006 | Okamoto et al. | 347/85 |
| 2008/0231650 | A1 | 9/2008 | Kojima | |
| 2008/0273064 | A1 * | 11/2008 | Ota et al. | 347/85 |

FOREIGN PATENT DOCUMENTS

| | | | |
|---|---|---|---|
| EP | 931662 | | 7/1999 |
| EP | 931662 | A2 | 7/1999 |
| EP | 1598192 | A2 | 11/2005 |
| JP | 08-244250 | A | 9/1996 |
| JP | H09-104120 | A | 4/1997 |
| JP | 11-207993 | A | 8/1999 |
| JP | 2007-007945 | A | 1/2007 |
| JP | 2007-301799 | A | 11/2007 |
| RU | 22954450 | | 3/2007 |

* cited by examiner

*Primary Examiner* — Jannelle M Lebron
(74) *Attorney, Agent, or Firm* — Canon USA Inc IP Division

(57) ABSTRACT

A recording apparatus has: a recording head having a liquid chamber and nozzles; a tank that stores the liquid which is supplied to the recording head; a liquid supply path that supplies the liquid from the tank to the liquid chamber; a supply pump provided on the liquid supply path; a liquid return path that returns the liquid from the liquid chamber to the tank; a return pump provided on the liquid return path; and a control unit that controls the supply pump and the return pump, wherein when the liquid is initially filled into the liquid chamber, the control unit drives the return pump so as to set the liquid chamber into a negative pressure state and subsequently drives the supply pump. The recording apparatus which can fill the liquid at a high speed without raising a pressure of a flow path can be provided.

13 Claims, 13 Drawing Sheets

RECORDING APPARATUS

BACKGROUND OF THE INVENTION

1. Field of the Invention

The present invention relates to a recording apparatus for recording by discharging a liquid such as ink and, more particularly, to a recording apparatus in which a liquid is supplied from a tank fixed to a recording apparatus main body having a recording head for discharging the liquid and the unused liquid is returned from the recording head to the tank.

2. Description of the Related Art

A recording head which is mounted in an ink jet recording apparatus records an image onto a recording medium such as paper by discharging minute ink droplets from minute discharge ports. In particular, a recording apparatus of a full line type using a line type recording head in which a number of discharge ports are arranged in the sheet width direction can realize a higher recording speed.

FIG. 14 illustrates an ink jet recording apparatus disclosed in Japanese Patent Application Laid-Open No. H09-104120. In FIG. 14, an ink jet head 1011 has a common liquid chamber 1012 and nozzles 1020. A supply tube 1017 as a flow path of supply ink to the common liquid chamber and a collecting tube 1016 as a flow path of collection ink from the common liquid chamber are respectively connected to both end portions of the common liquid chamber 1012 of the ink jet head 1011. The supply tube 1017 and the collecting tube 1016 are also connected to an ink ejecting portion 1013*a* and an ink inflow portion 1013*b* of an ink circulating pump 1013, respectively. The supply tube 1017 is constructed by: a three-directional joint 1017*c*; a tube 1017*a* on the common liquid chamber side of, and connected to, the joint 1017*c*; and a tube 1017*b* on the ink circulating pump side of the joint 1017*c*.

In an ink supply pump 1014, an ink inflow portion 1014*a* is connected to a main ink tank 1015 by a tube 1019 and an ink ejecting portion 1014*b* is connected through an inflow tube 1018 to the 3-directional joint 1017*c* provided halfway along the supply tube 1017.

There has been disclosed such a technique that at the time of the recovery operation by the ink circulation, the ink circulating pump 1013 and the ink supply pump 1014 are made operative and, in each of the pump portions, the ink is moved in the direction shown by an arrows A in the diagram.

According to the construction disclosed in Japanese Patent Application Laid-Open No. H09-104120, when the ink is initially filled into the ink jet head 1011, the ink is filled with a pressure from both sides of the common liquid chamber 1012 by the ink circulating pump 1013 (pumping the opposite way) and the ink supply pump 1014. At this time, while the ink is filled toward a center portion in the common liquid chamber 1012, the air in the common liquid chamber 1012 is ejected to the atmosphere from the nozzles 1020. However, there is such a problem that the air near the center portion in the common liquid chamber 1012 cannot be completely exhausted.

Therefore, according to the construction disclosed in Japanese Patent Application Laid-Open No. H09-104120, the ink circulating pump 1013 and the ink supply pump 1014 are made normally operative and the ink in the common liquid chamber 1012 is circulated, as mentioned above, thereby exhausting the air in the common liquid chamber 1012. At this time, the ink in the common liquid chamber 1012 is ejected from the nozzles 1020 together with the air.

In particular, in the recording apparatus of the full line type using the line type recording head in which a number of discharge ports are arranged in the sheet width direction, there is such a problem that a large quantity of drain ink occurs. The sheet width direction is typically the direction perpendicular to the direction of travel of the sheet, and so parallel to the longitudinal axis of the line of discharge ports.

If a pressure or a rotational speed of the ink circulating pump 1013 or the ink supply pump 1014 is decreased in order to reduce the amount of drain ink at the time of the initial filling of the ink, the filling time becomes long.

SUMMARY OF THE INVENTION

It is an object of the invention to provide a recording apparatus in which a recording head and a tank arranged in an apparatus main body are connected by a flow path such that when a liquid is initially filled into the recording head, the liquid can be filled at a high speed without raising a pressure in the flow path.

Another object of the invention is to provide a recording apparatus comprising: a recording head having a liquid chamber for storing a liquid and at least one nozzle for discharging the liquid; a tank for storing the liquid which is to be supplied to the recording head; a liquid supply path for supplying the liquid from the tank to the liquid chamber; a supply pump provided in the liquid supply path; a liquid return path for returning the liquid from the liquid chamber to the tank; a return pump provided in the liquid return path; and a control unit for controlling driving of the supply pump and the return pump, wherein, when the liquid is to be introduced into the liquid chamber, the control unit is configured, in a first stage, to drive the return pump so as to cause a negative pressure state in the liquid chamber and, in a second stage, to drive the supply pump.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Embodiment 1

Figure 1:
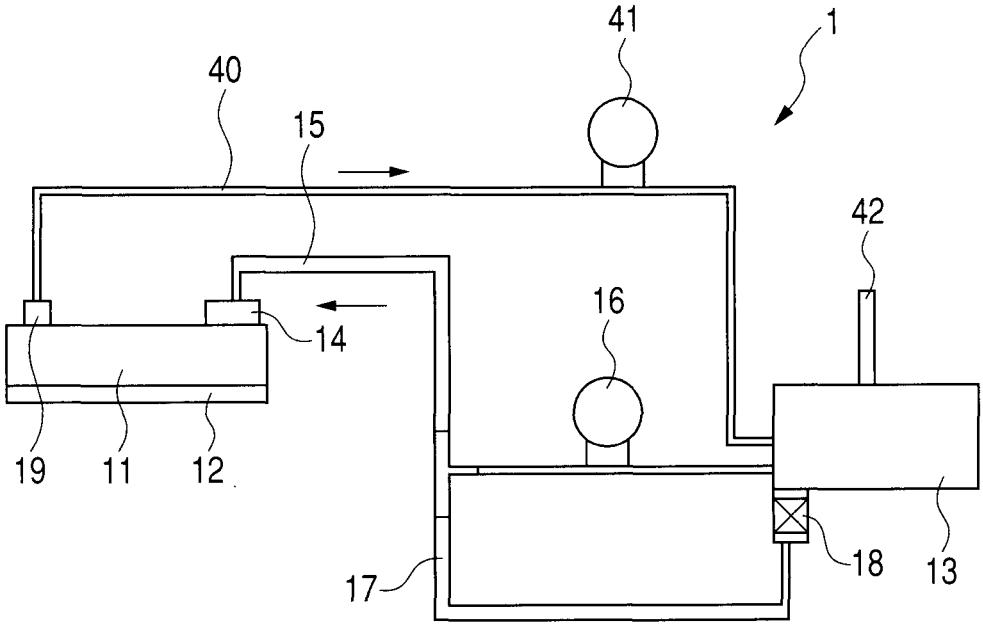
FIG. 1 is a diagram illustrating a construction of a first embodiment of the invention.
Figure 2:
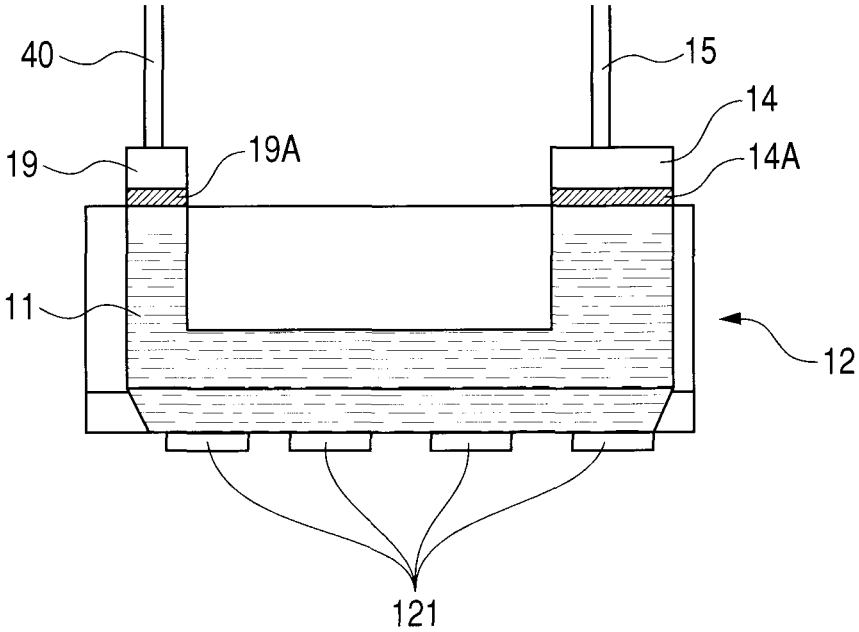
FIG. 2 is a cross-sectional view of a recording head.

An embodiment 1 of the invention will be described with reference to FIGS. 1 to 5. FIG. 1 is a diagram illustrating a construction of the embodiment 1 of the invention. FIG. 2 is a cross sectional view of a recording head.

A recording apparatus 1 of the embodiment has a construction in which a color image is recorded onto a recording medium by using a plurality of ink jet heads. The recording apparatus 1 has an ink jet head for each color. The recording apparatus 1 also has an ink tank of each color for storing ink to be supplied to the ink jet head corresponding to each color. The recording apparatus 1 also has an ink supply path for each color. The ink stored in the ink tank of each color is supplied to the ink jet head of each color by the ink supply path of each color. The recording apparatus 1 also has an ink return path for each color. The ink is returned to the ink tank of each color from the ink jet head of each color by the ink return path of each color. The construction of the ink jet head, ink tank, ink supply path, and ink return path mentioned above is common to a plurality of colors. FIG. 1 illustrates the ink jet head, ink tank, ink supply path, ink return path, and other constructions corresponding to the first color, and corresponding constructions of the colors other than the first color are omitted here.

First, a construction of an ink jet head 12 will be described with reference to FIG. 2. The ink jet head 12 has: a liquid chamber 11 for storing the ink; and nozzle tips 121 having a plurality of nozzles adapted to discharge the ink and electrothermal converting elements each provided for every nozzle. The ink jet head 12 also has a supply port 14 and is connected to an ink supply path 15 by the supply port 14. A filter 14A is provided for the supply port 14. The ink jet head also has a return port 19 and is connected to an ink return path 40 by the return port 19. A filter 19A is provided for the return port 19.

Subsequently, a construction of an ink tank 13 will be described with reference to FIG. 1. The ink tank has an atmosphere communication port 42 communicated with the atmosphere. The ink tank 13 is connected to the ink supply path 15 and the ink return path 40.

A construction in which the ink is circulated between the ink jet head 12 and the ink tank 13 will now be described. There are three basic stages; running only the return pump, running the supply pump as well to obtain equilibrium between the two pumps, and running the return pump in reverse. The third stage is optional. The ink stored in the ink tank 13 is supplied to the liquid chamber 11 by the ink supply path 15 which connects the ink tank 13 and the liquid chamber 11 of the ink jet head 12. A supply pump 16 is provided on the way of the ink supply path 15. By driving the supply pump 16, the ink is supplied to the liquid chamber 11 from the ink tank 13. An ink parallel supply path 17 is provided for the recording apparatus 1 in correspondence to the portion where the supply pump 16 on the ink supply path 15 has been provided. On the downstream side of the supply pump 16, the ink parallel supply path 17 is connected to the ink supply path 15. The ink parallel supply path 17 is connected to the ink tank 13 by an on/off valve 18. By controlling the on/off valve 18, the apparatus can be switched to either a state where the ink tank 13 and the ink parallel supply path 17 have been connected or a state where the ink tank 13 and the ink parallel supply path 17 have been disconnected.

The ink in the liquid chamber 11 is returned to the ink tank 13 by the ink return path 40 which connects the liquid chamber 11 and the ink tank 13. A return pump 41 is provided on the way of the ink return path 40. By driving the return pump 41, the ink is returned to the ink tank 13 from the liquid chamber 11.

Figure 3:
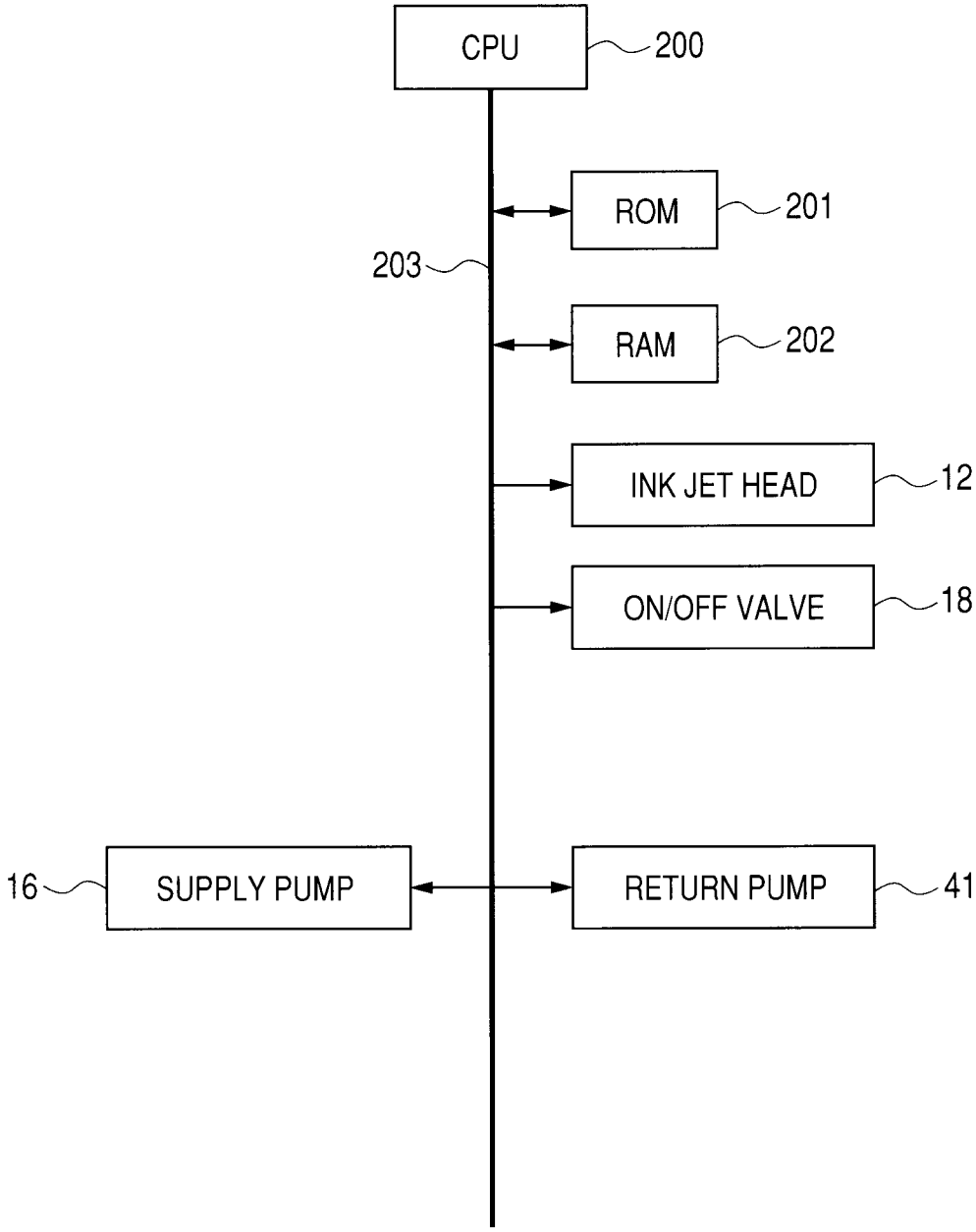
FIG. 3 is a circuit block diagram of the embodiment 1.

FIG. 3 is a circuit block diagram of the embodiment 1. In FIG. 3, a CPU 200 controls the recording apparatus and generates control commands. A control program, a control table, and control data have been stored in a ROM 201. A RAM 202 is used as an area for storing data developed for image processes and is used as an area for temporarily storing other control parameters. The data and the control commands are transferred through a bus 203.

The control commands from the CPU 200 are transferred to the supply pump 16, return pump 41, on/off valve 18, and ink jet head 12 through the bus 203, thereby making them operative in response to each command.

Figure 4:
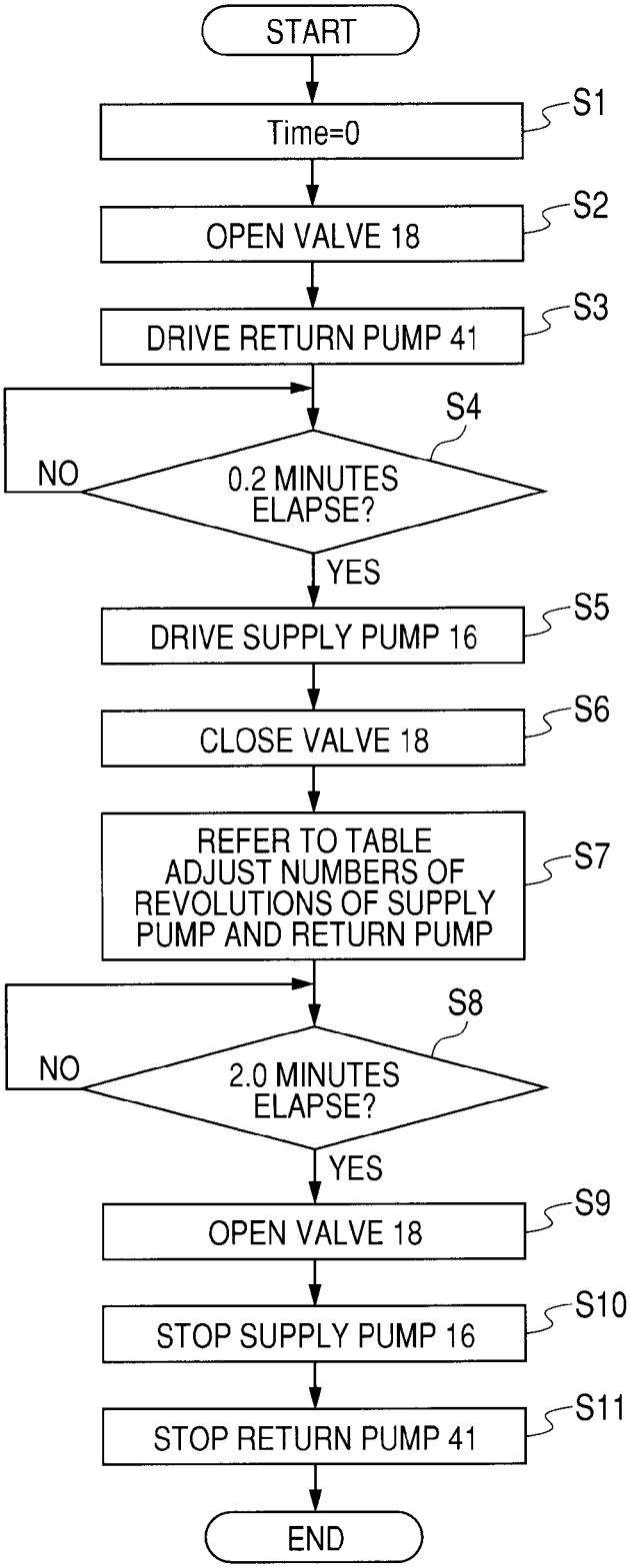
FIG. 4 is a control flowchart of the first embodiment.
Figure 5:
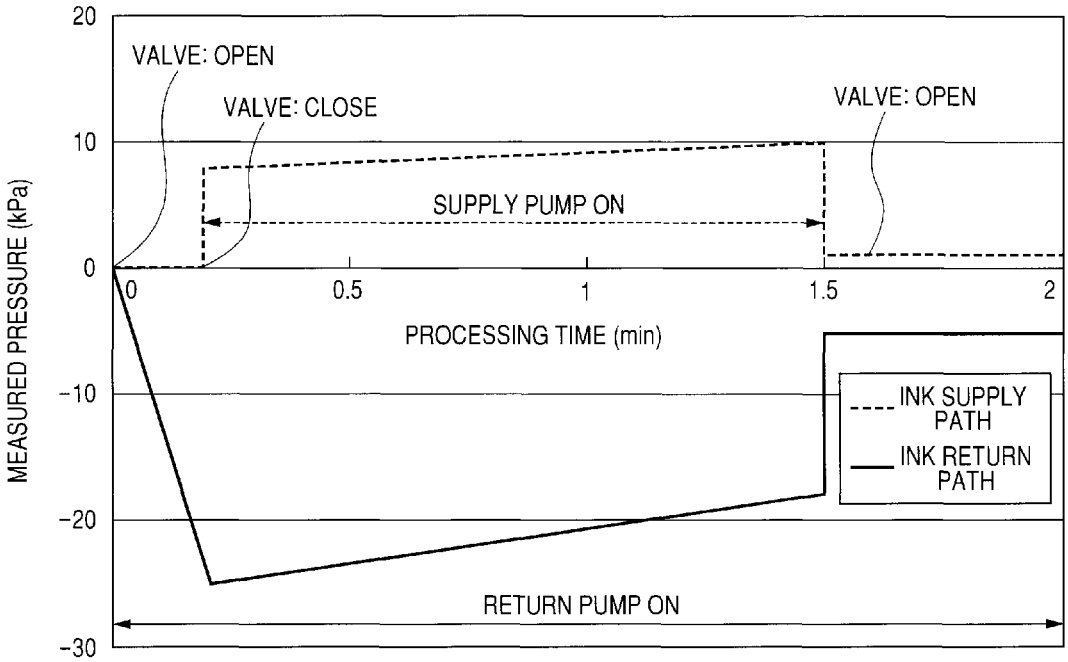
FIG. 5 is a diagram illustrating pressure changes of an ink supply path and an ink return path of the first embodiment.

FIG. 4 is a control flowchart of the embodiment 1. FIG. 5 is a diagram illustrating pressure changes of the ink supply path and the ink return path of the embodiment 1. The operation at the time of initially filling the ink into the ink jet head 12 will now be described with reference to FIGS. 4 and 5.

First, the ink jet head 12 is mounted into the recording apparatus 1. In the embodiment, a capacity of the liquid chamber 11 of the ink jet head 12 is equal to about 15 ml. About 2 ml of ink may have been stored in the liquid chamber 11 and the nozzle of the ink jet head 12 in order to prevent them from drying.

Subsequently, when the initial filling operation is started, a timer is set to 0 minutes as shown in step S1 in FIG. 4.

Subsequently, by turning on the on/off valve 18 using, for example, a solenoid (or electromagnet), the valve is opened in step S2.

A nozzle surface of the ink jet head 12 is set to a position which is higher by 150 mm than the bottom surface of the ink tank 13. Therefore, a negative pressure in the ink jet head 12 that is caused by such a height difference and a meniscus force of the ink in the nozzle enter an equilibrium state, thereby preventing the ink from dropping down from the nozzle and preventing the air from being sucked up through the nozzle.

Subsequently, the return pump 41 is driven by a motor in step S3. For example, the motor for making the return pump 41 operative is driven at a rotational speed of 1400 pps (pulses per second) so that a flow rate of the return pump 41 is equal to 8 ml/min, thereby setting the liquid chamber 11 of the ink jet head 12 into the negative pressure state.

When a time of about 0.1 to 0.2 minute elapses (S4) from the driving start of the return pump 41, the ink (sometimes known as physical distribution ink) in the ink jet head 12 flows out of the return port 19 to the ink return path 40. At this time, the air in the ink jet head is also mixed as bubbles with the physical distribution ink (or forms a single large bubble within the ink) and flows out to the ink return path 40.

The ink stored in the ink tank 13 then flows into the liquid chamber 11 of the ink jet head 12 through the ink parallel supply path 17 and the supply port 14.

As mentioned above, FIG. 5 is a diagram illustrating pressure changes of the ink supply path and the ink return path. The pressure may be measured by a pressure gauge. In FIG. 5, a broken line indicates the pressure change of the ink supply path 15 at a position on the downstream side of the supply pump 16, that is, at a position on the downstream side of the position where the ink parallel supply path 17 is connected to the ink supply path 15. A solid line indicates the pressure change of the ink return path 40 at a position on the upstream side of the return pump 41. Now paying attention to the pressure of the ink return path 40 shown by the solid line, when a time of about 0.1 to 0.2 minute elapses from the driving start, the pressure indicates a value within a range from −20 to −25 kPa and exceeds a bubble point (for example, −5 kPa) of the filter 19A provided at the return port 19. It will be, therefore, understood that the physical distribution ink containing the bubbles flows out of the return port 19 into the ink return path 40. At this time, since the pressure in the liquid chamber 11 is also entering the negative pressure state in a manner similar to the ink return path 40, the new ink flows into the liquid chamber 11 from the supply port 14.

Subsequently, when the time of 0.2 minute of the timer elapses in step S4, the supply pump 16 is driven in step S5. Subsequently, by turning off the on/off valve 18 in step S6, the valve is closed.

In step S7, the flow rate of the return pump 41 and the flow rate of the supply pump 16 are adjusted so as not to suck the air from the nozzle and the return pump 41 and the supply pump 16 are driven. For example, the motor for making the supply pump 16 operative is driven at a rotational speed of 2000 pps so that a flow rate (or flow volume) of the supply pump 16 is equal to 10 ml/min as compared with the flow rate of 8 ml/min of the return pump 41.

By driving the supply pump 16, ink with flow rate 10 ml/min is supplied with a specified pressure from the ink tank 13 through the supply port 14 to the nozzle of the ink jet head 12 and to the liquid chamber 11. Using the negative pressure in the liquid chamber, the ink gradually fills the liquid chamber toward the return port 19 side from the side near the supply port 14. Each nozzle forms a meniscus of the ink. The air bubble in the liquid chamber 11 is gradually expelled while being pressed and transported to the return port 19 side.

At this time, when the pressure in the liquid chamber 11 exceeds a meniscus-holding force (for example, about 5 kPa) of the nozzle, the ink drops from the nozzle. When the pressure in the liquid chamber 11 exceeds the meniscus-holding force, the physical distribution ink mentioned above is also expelled from the nozzle.

An amount of drainage ink which drops from the nozzle can be reduced by adjusting the pressure state in the liquid chamber 11 by controlling the flow rates of the supply pump 16 and the return pump 41.

When referring to FIG. 5, the pressure of the ink supply path 15 shown by the broken line rises gradually from +8 kPa to +10 kPa for a time interval until the time of 1.5 minutes of the timer elapses, or just after the ink has been supplied to the liquid chamber. The negative pressure (i.e. vacuum suction) of the ink return path 40 shown by the solid line decreases gradually from −25 kPa to −18 kPa. It is, therefore, presumed that the pressure in the liquid chamber 11 changes gradually from a state of −17 kPa (=−25+8) to a state of −8 kPa (=−18+10) and it will be understood that the ink gradually fills the liquid chamber 11.

Finally, when the time of 2 minutes of the timer elapses in step S8, the on/off valve 18 is opened in step S9. Further, the driving of the supply pump 16 is stopped in step S10, the driving of the return pump 41 is stopped in step S11. The filling operation of the ink is finished.

As mentioned above, in the embodiment, at the time of the initial filling, the return pump 41 is first driven and the physical distribution ink in the ink jet head 12 is expelled via the return path 40. Subsequently, the supply pump 16 is driven while adjusting a balance between the flow rates of the supply pump and the return pump so that the air is not sucked in via the nozzle and the ink does not leak out through the nozzle. By controlling as mentioned above, an amount of drain ink which is ejected from the nozzle can be minimised.

Besides the initial filling of the ink, in the case of filling the ink into the ink jet head when the ink level is too low in the ink jet head which has already been mounted, or also in the case of expelling the bubble remaining in the liquid chamber, by making similar control, the drain ink amount can be minimised and the liquid chamber can be filled with ink.

By increasing both of the flow rates of the return pump and the supply pump, the flow rate of the ink which is supplied to the liquid chamber can be increased and the ink can be filled at a high speed at the time of filling the ink. In this instance, since a balance between the pressure of the supply pump on the pressurizing side and the pressure of the return pump on the negative pressure side is obtained in the liquid chamber, an increase in pressure in the liquid chamber or in the ink flow path can be prevented.

Subsequently, setting of the flow rates of the supply pump and the return pump in order to further decrease the drain ink amount and to fill the ink at a further high speed will be described hereinbelow.

When the ink is filled, such a combination of the flow rates of the supply pump and the return pump that the air is not sucked from the nozzle is preliminarily measured and those pumps are made operative according to the combination.

A method of deciding the combination of the flow rates of the supply pump and the return pump will now be described. A tube pump whose maximum output is equal to 15 ml/min is used as each of the supply pump and the return pump, the initial filling of the ink mentioned above is performed, and a state of the nozzle is observed. Table 1 shows such a combination of the flow rates (ml/min) of the supply pump and the return pump that the air is not sucked from the nozzle.

TABLE 1

| | | | | |
|---|---|---|---|---|
| Supply Pump | 6 | 9 | 12 | 15 |
| Return Pump | −6 | −15 | −15 | −15 |
| Feature | Drain Ink Amount is Small ← | | →Filling Time is Short | |

It will be understood from Table 1 that the flow rate of the supply pump at which the drain ink amount is minimum is equal to 6 ml/min and the flow rate of the supply pump at which the ink filling time is shortest is equal to 15 ml/min. As a flow rate of the return pump at this time, the maximum value within such a range that the air is not sucked from the nozzle is desirable in order to decrease the drain ink amount and to shorten the ink filling time. When selecting from the above viewpoint, the flow rate of the return pump when the flow rate of the supply pump is equal to 6 ml/min is equal to −6 ml/min, and the flow rate of the return pump when the flow rate of the supply pump is equal to 9 to 15 ml/min is equal to −15 ml/min.

By selecting the flow rates of the supply side pump and the return side pump by using the table obtained as mentioned above, the shorter filling time and the smaller drain ink amount can be realized.

Subsequently, the recording operation in the recording apparatus of the embodiment 1 will be described.

When the recording is executed by the ink jet head 12, the supply pump 16 and the return pump 41 are stopped and the on/off valve 18 is opened.

In the embodiment, a liquid surface of the ink stored in the tank 13 is set so as to be lower than a nozzle surface of the ink jet head 12 in the weight direction. The pressure in the liquid chamber 11 is always less than the atmospheric pressure. Since the pressure in the liquid chamber 11 is in the negative pressure state as mentioned above, the ink does not leak from the nozzle.

When the ink is discharged from the nozzle, the pressure in the liquid chamber 11 further decreases due to a capillary force of the nozzle. Since an absolute value of the negative pressure in the liquid chamber 11 increases, the ink is supplied from the ink tank 13 to the ink jet head 12 through the ink parallel supply path 17 and the ink supply path 15 (which is not under pressure by a pump, but is open to atmospheric pressure).

When the recording apparatus 1 is used for a long time, air bubbles are accumulated in the liquid chamber 11 of the ink jet head 12. The ventilating operation for expelling the accumulated bubbles will be described. The supply pump 16 and the return pump 41 are stopped and the on/off valve 18 is opened. Subsequently, the return pump 41 is driven, thereby causing the ink to flow out of the liquid chamber 11 of the ink jet head 12 via the return path 40. Thus, the bubble is expelled (or in fact sucked) from the liquid chamber 11 together with the ink. The expelled ink and bubble(s) pass through the ink return path 40 and move to the ink tank 13. By driving the return pump 41, the pressure in the liquid chamber 11 decreases and the ink is supplied from the ink tank 13 to the ink jet head 12 through the ink parallel supply path 17 and the ink supply path 15.

Embodiment 2

Figure 6:
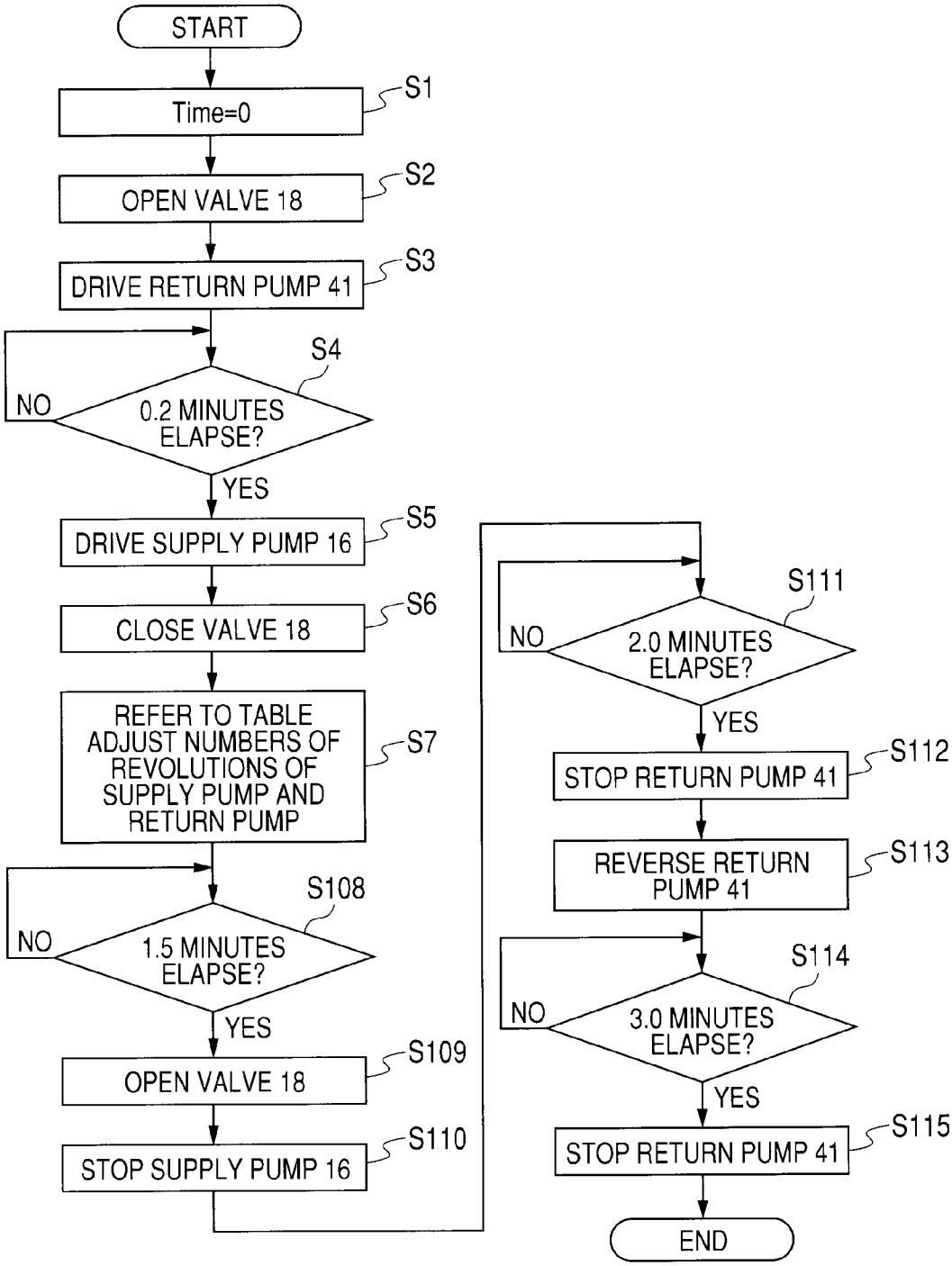
FIG. 6 is a control flowchart of a second embodiment.

Embodiment 2 of the invention will be described with reference to FIG. 6. FIG. 6 is a control flowchart of embodiment 2. The embodiment has a construction in which the drain ink amount at the time of the ink initial filling can be further reduced compared with that in the first embodiment. The operation at the time when the ink is initially filled into the ink jet head 12 will now be described with reference to FIG. 6. A construction of ink flow paths of the ink jet head and the ink tank is similar to that in FIG. 1.

The ink jet head 12 is mounted in the recording apparatus 1 and the initial filling operation is started. Since the processes in steps S1 to S7 are the same as those in the embodiment 1, their description is omitted here.

In step S108 following step S7, whether or not a time of 1.5 minutes of the timer has elapsed is determined. If it is decided that the time of 1.5 minutes has elapsed, the on/off valve 18 is opened in step S109. Subsequently, the supply pump 16 is stopped in step S110.

Thus, the ink of the flow rate (for example, 8 ml/min) according to the return pump 41 is supplied from the ink tank 13 to the liquid chamber 11 through the ink parallel supply path 17 thanks to the sucking action of the return pump on the ink via the return path 40, the liquid chamber 11 and the supply paths 15 and 17.

The ink containing the bubbles in the liquid chamber 11 is sent to the ink tank 13 from the return port through the ink return path 40. The bubbles contained in the ink in the liquid chamber 11 and the ink return path 40 are stored in the ink tank 13. Some of the bubbles are ejected to the outside of the ink tank through the atmosphere communication port 42 and some of them are dissolved into the ink and effectively disappear.

When it is determined in step S111 that a time of 2 minutes of the timer has elapsed, the driving of the return pump 41 is stopped in step S112.

Subsequently, the return pump 41 is reversely rotated at a motor rotational speed of 1400 pps in step S113. By reversely rotating the return pump 41, the ink is supplied from the ink tank 13 toward the ink jet head 12 backwards through the return path 40.

When it is determined in step S114 that a time of 3 minutes of the timer has elapsed, the reverse rotation of the return pump 41 is stopped in step S115 and the ink filling operation is finished.

In the embodiment, by reversely rotating the return pump 41, the ink in the ink tank 13 flows into the liquid chamber 11 through the ink return path 40 and the return port 19. Simultaneously, the ink flows from the liquid chamber 11 to the supply port 14 and the ink parallel supply path 17.

By reversing the flow of the ink as mentioned above, the bubbles stopped by the filter 14A of the supply port 14 are accumulated into the ink tank 13 through the ink parallel supply path 17.

Some of the bubbles are ejected to the outside of the ink tank through the atmosphere communication port 42 and some of them are dissolved into the ink and disappear.

As mentioned above, in the second embodiment, before the initial filling operation is finished, the return pump is reversely rotated and the ink flows in reverse so that the bubbles stopped by the filter of the supply port can be also removed.

Embodiment 3

Figure 7:
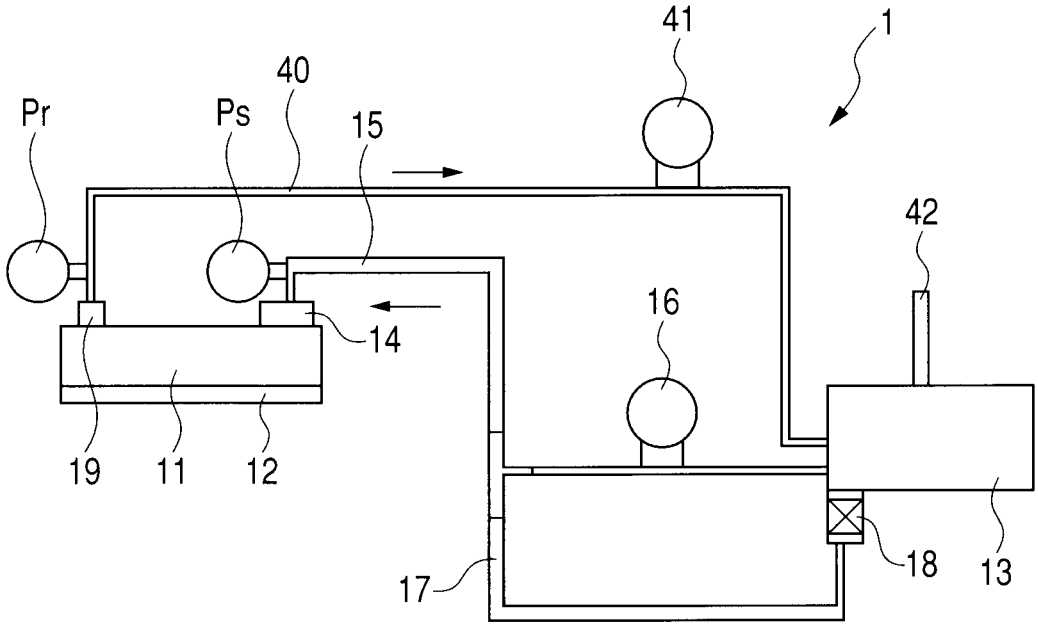
FIG. 7 is a diagram illustrating a construction of a third embodiment.

An embodiment 3 of the invention will be described with reference to FIGS. 7 to 9. FIG. 7 is a diagram for describing a construction of the embodiment 3. The embodiment is characterized in that pressure sensors are provided near the return port 19 and the supply port 14 of the ink jet head 12 in addition to the construction of the embodiment 1.

In FIG. 7, the recording apparatus 1 of the embodiment has: a return path pressure sensor Pr near the return port 19 in the ink return path 40; and a supply path pressure sensor Ps near the supply port 14 in the ink supply path 15.

The return path pressure sensor Pr measures the pressure in the flow path of the ink return path 40 on the upstream side of the return pump 41. The supply path pressure sensor Ps measures the pressure in the flow path of the ink supply path 15 on the downstream side of the supply pump 16.

Figure 8:
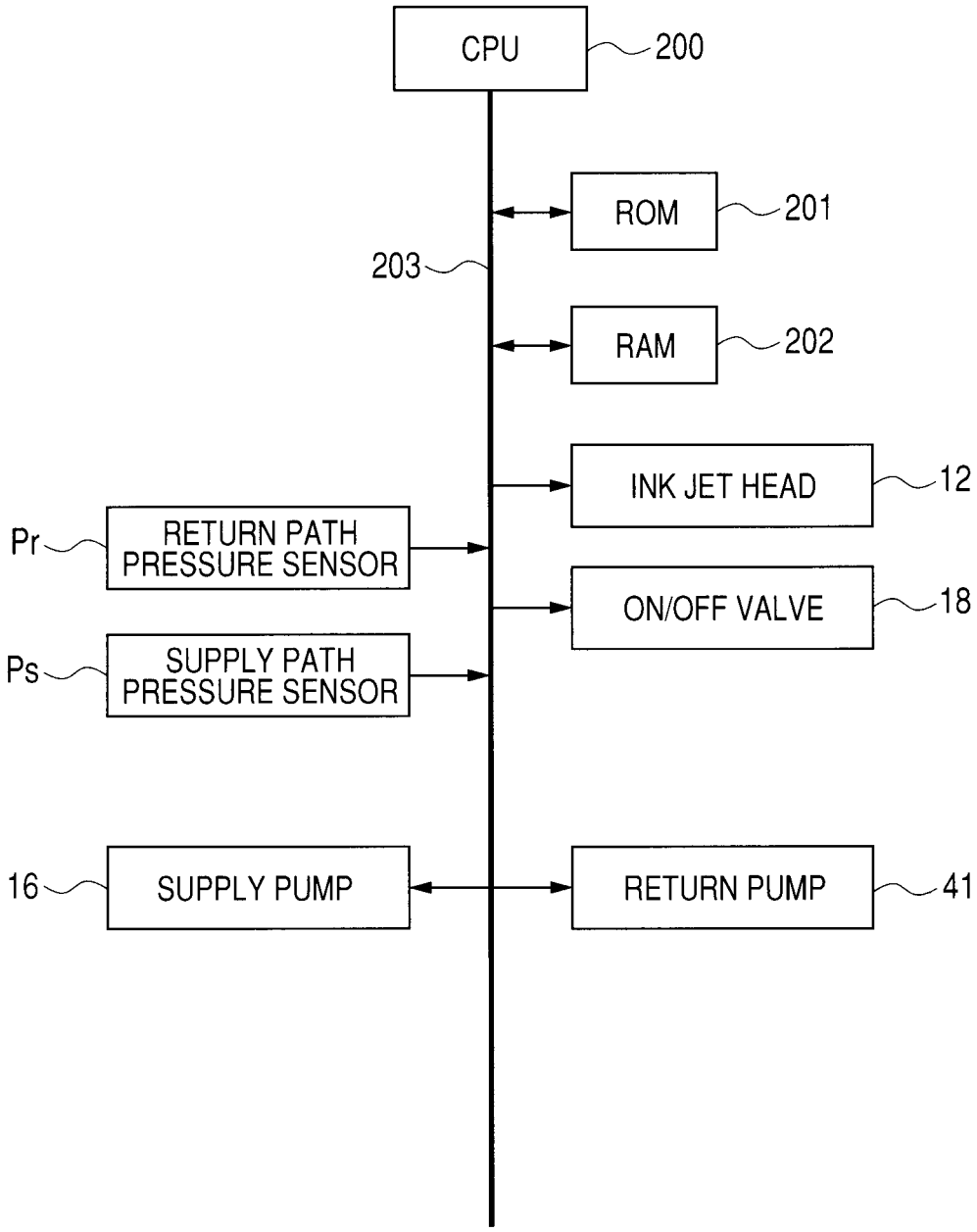
FIG. 8 is a circuit block diagram of the third embodiment.

FIG. 8 is a circuit block diagram of the embodiment 3. In FIG. 8, the return path pressure sensor Pr and the supply path pressure sensor Ps are connected to the bus 203 and operate according to commands from the CPU 200.

Figure 9:
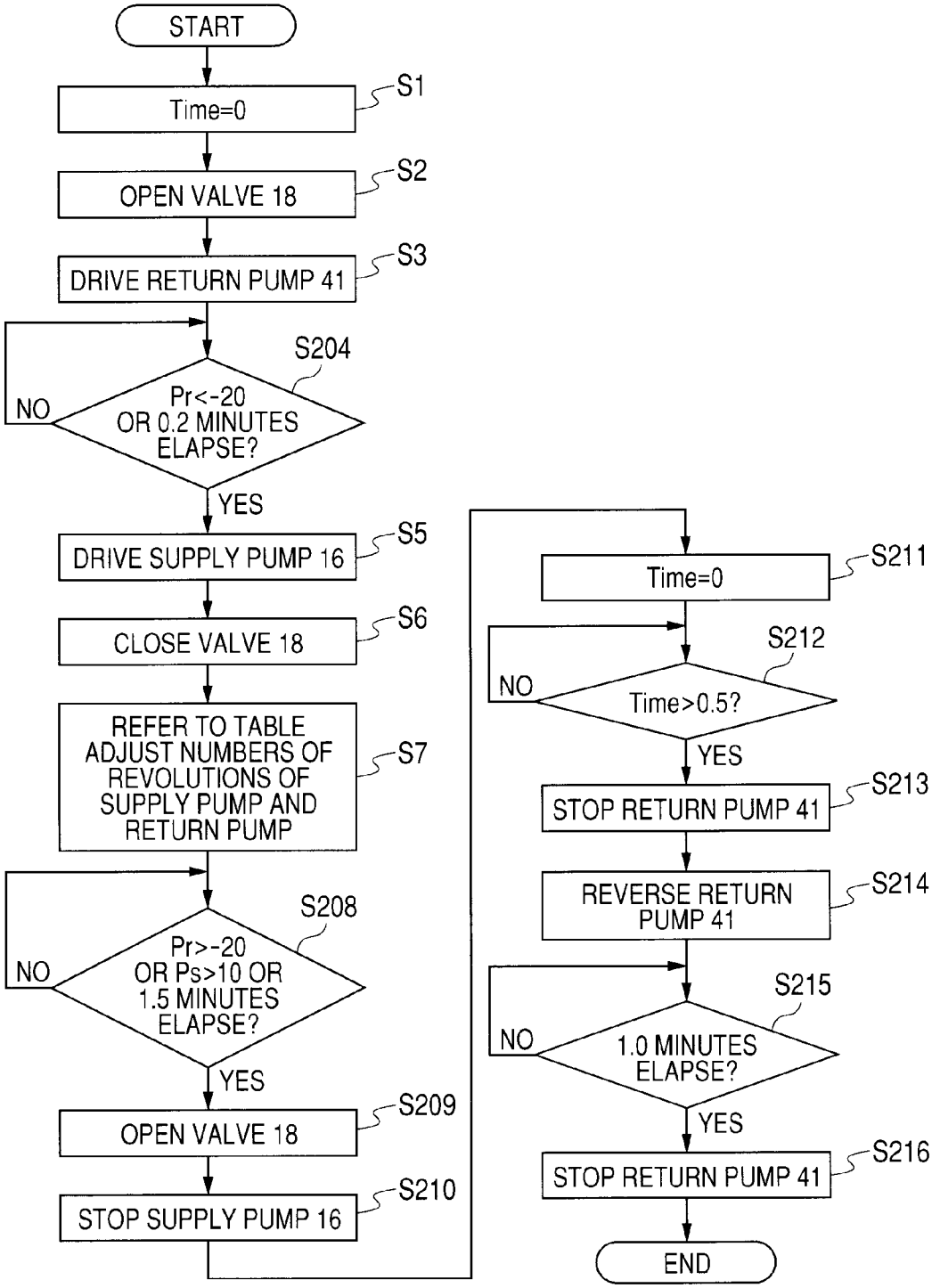
FIG. 9 is a control flowchart of the third embodiment.

FIG. 9 is a control flowchart of embodiment 3. Since the processes in steps S1 to S3 are the same as those in the embodiment 1, their description is omitted here.

In step S204 subsequent to step S3, after the driving of the return pump 41 is started, if the return path pressure sensor Pr detects the pressure lower than a first threshold value or if a time of 0.2 minutes or longer has elapsed, the processing routine advances to step S5. In the embodiment, the first threshold value is assumed to be −20 kPa. The invention may include, as a trigger for turning on the supply pump, either the time elapsed as measured by the timer, or the threshold value of pressure as measured by the pressure sensor, or both (and the trigger may be whichever of time elapsed or threshold occurs first, for example, or the trigger is that both have occurred).

When the same processes of steps S5 to S7 as those in the embodiment 1 are finished, the processing routine advances to step S208.

In step S208, if the return path pressure sensor Pr detects a pressure higher than the first threshold value, if the supply path pressure sensor Ps detects a pressure higher than a second threshold value, and/or if a time of 1.5 minutes of the timer has elapsed, the processing routine advances to step S209. In the embodiment, the second threshold value is assumed to be 10 kPa.

In step S209, the on/off valve 18 is opened. Subsequently, in step S210, the supply pump 16 is stopped. In step S211, the timer is reset to 0 minute.

When it is determined in step S212 that a time of 0.5 minutes of the timer has further elapsed, the driving of the return pump 41 is stopped in step S213. Rather than using a timing for this step, a pressure sensor or volume sensor in the supply path, return path or liquid chamber may be used. After that, the return pump 41 is reversely rotated at a rotational speed of 1400 pps in step S214. By reversely rotating the return pump 41, the ink is supplied from the ink tank 13 toward the ink jet head 12 backwards via the return path 40.

When it is determined in step S215 that a time of 1 minute of the timer has elapsed (or a sensor senses that the liquid chamber is full of ink), the reverse rotation of the return pump 41 is stopped in step S216 and the ink filling operation is finished.

In the embodiment, by reversely driving the return pump 41, the ink in the ink tank 13 flows through the ink return path 40, return port 19, liquid chamber 11, supply port 14, and ink parallel supply path 17.

By reversely flowing the ink as mentioned above, the bubbles stopped by the filter 14A of the supply port 14 also flow in reverse and are accumulated into the ink tank 13 through the ink parallel supply path 17.

By controlling the supply pump, the return pump, and the on/off valve by the sensors for detecting the flowing state of the ink as mentioned above, the ink filling operation can allow a smaller drain ink amount and a shorter filling time.

Embodiment 4

Figure 10:
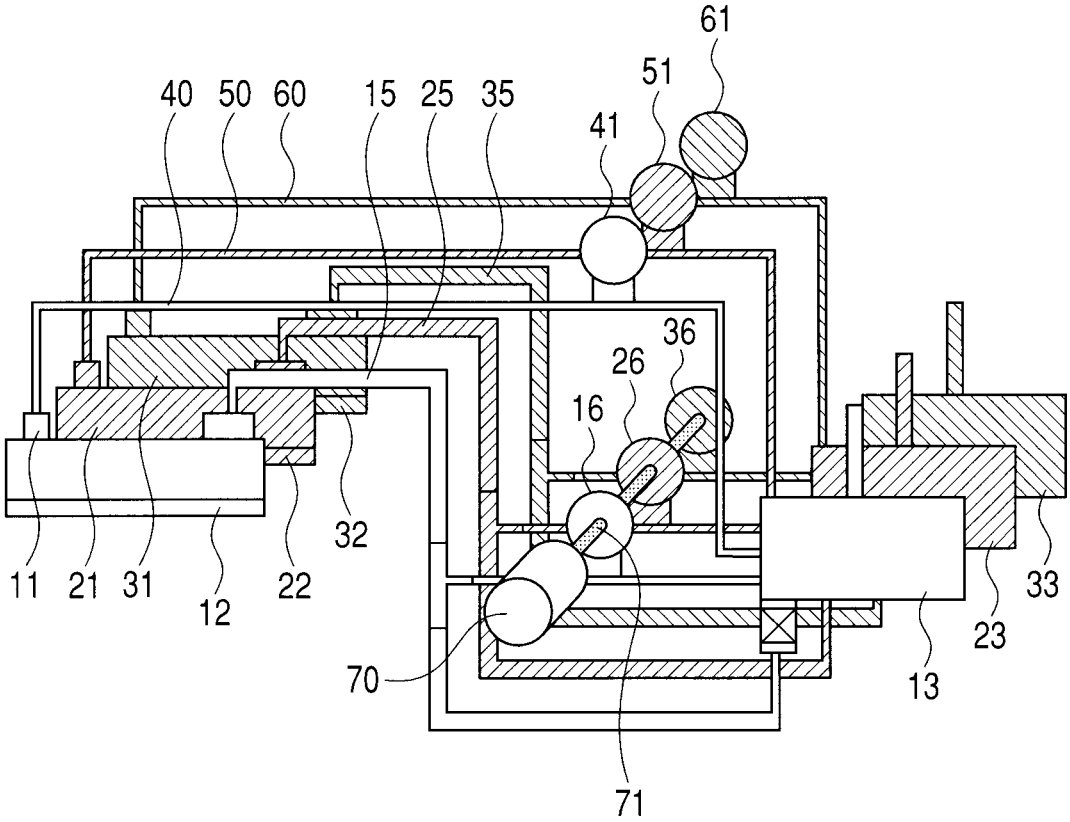
FIG. 10 is a diagram illustrating a construction of a fourth embodiment.

An embodiment 4 of the invention will be described with reference to FIG. 10. FIG. 10 is a diagram illustrating a construction of embodiment 4. In addition to the ink jet head, ink tank, ink supply path, ink return path, and other constructions corresponding to the first color of ink, the embodiment 4 has a construction corresponding to the second color and the third color of ink. In FIG. 10, an ink jet head 22 discharges the ink of the second color and the ink of the second color is stored in an ink tank 23. The ink of the second color is supplied from the ink tank 23 to a liquid chamber 21 of the ink jet head 22 by an ink supply path 25. A supply pump 26 is provided on the way of the ink supply path 25. The ink of the second color is returned from the liquid chamber 21 to the ink tank 23 by an ink return path 50. A return pump 51 is provided on the way of the ink return path 50.

Similarly, an ink jet head 32 discharges the ink of the third color and the ink of the third color is stored in an ink tank 33. The ink of the third color is supplied from the ink tank 33 to a liquid chamber 31 of the ink jet head 32 by an ink supply path 35. A supply pump 36 is provided on the way of the ink supply path 35. The ink of the third color is returned from the liquid chamber 31 to the ink tank 33 by an ink return path 60. A return pump 61 is provided on the way of the ink return path 60.

In the embodiment 4, the three supply pumps 16, 26, and 36 are driven by a common driving axis 71 and the driving axis 71 is rotated by one supply motor 70. By such a construction, in a construction in which a color image is recorded onto a recording medium by using ink jet heads of a plurality of colors, a miniaturization of the apparatus and a reduction in number of component parts can be realized.

Embodiment 5

Figure 11:
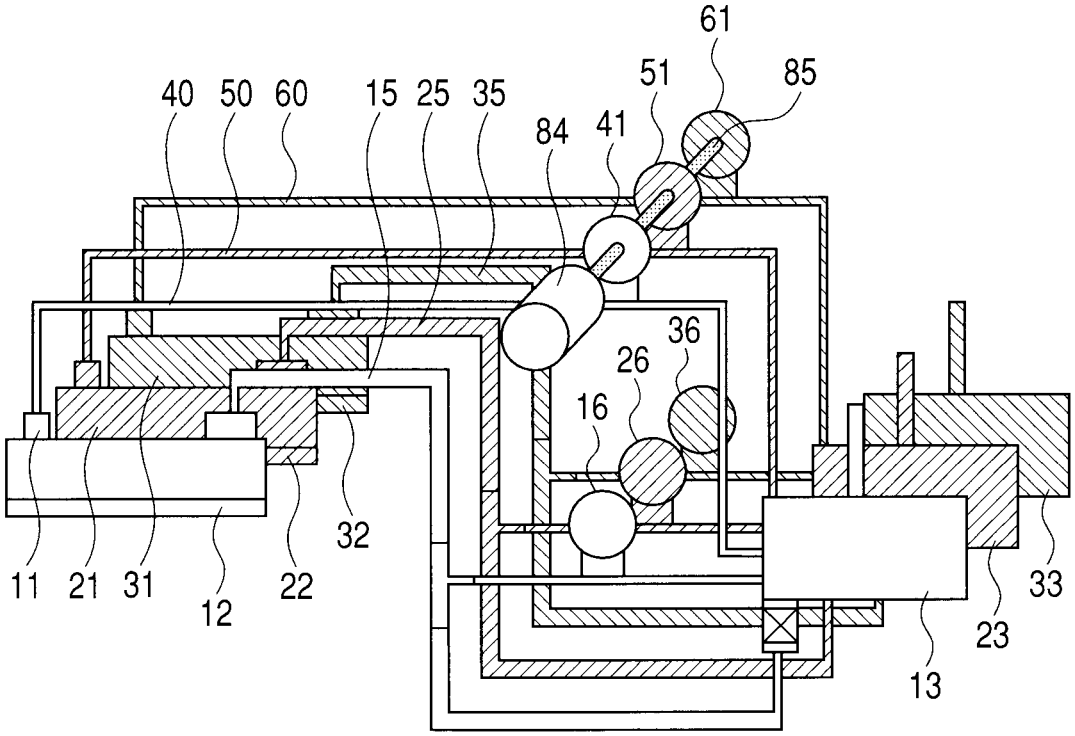
FIG. 11 is a diagram illustrating a construction of a fifth embodiment.

An embodiment 5 of the invention will be described with reference to FIG. 11. FIG. 11 is a diagram illustrating a construction of the embodiment 5. In a manner similar to the embodiment 4, the embodiment 5 also has a construction in which the ink corresponding to each of the first, second, and third colors is circulated.

In the embodiment 5, the three return pumps 41, 51, and 61 are driven by a common driving axis 85 and the driving axis 85 is rotated by one return motor 84. By such a construction, in a construction in which a color image is recorded onto a recording medium by using ink jet heads of a plurality of colors, a miniaturization of the apparatus and a reduction in number of component parts can be realized.

Further, the three supply pumps 16, 26, and 36 may be driven by one supply motor 70 and the three return pumps 41, 51, and 61 may be driven by the one return motor 84.

Embodiment 6

Figure 12:
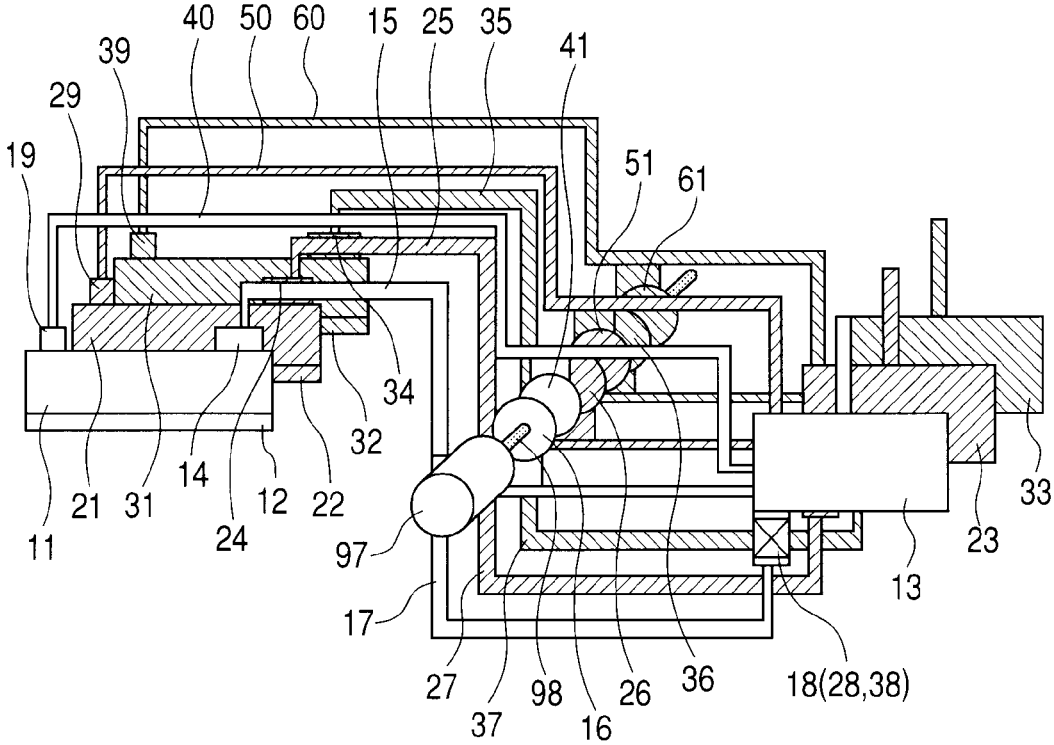
FIG. 12 is a constructional diagram for describing a sixth embodiment.

An embodiment 6 will be described with reference to FIGS. 12 and 13. FIG. 12 is a constructional diagram for describing the embodiment 6. In the embodiment 6, the three supply pumps 16, 26, and 36 and the three return pumps 41, 51, and 61 are driven by a common driving axis 98. The driving axis 98 is rotated by one driving motor 97.

In the construction having a plurality of ink jet heads, it is necessary to newly mount only a part of the ink jet heads to the apparatus and to make control for initially filling the corresponding ink. In FIG. 12, the ink parallel supply paths 27 and 37 are illustrated and on/off valves 28 and 38 are labelled but not visible. Supply ports 24 and 34 and return ports 29 and 39 are also illustrated.

Figure 13:
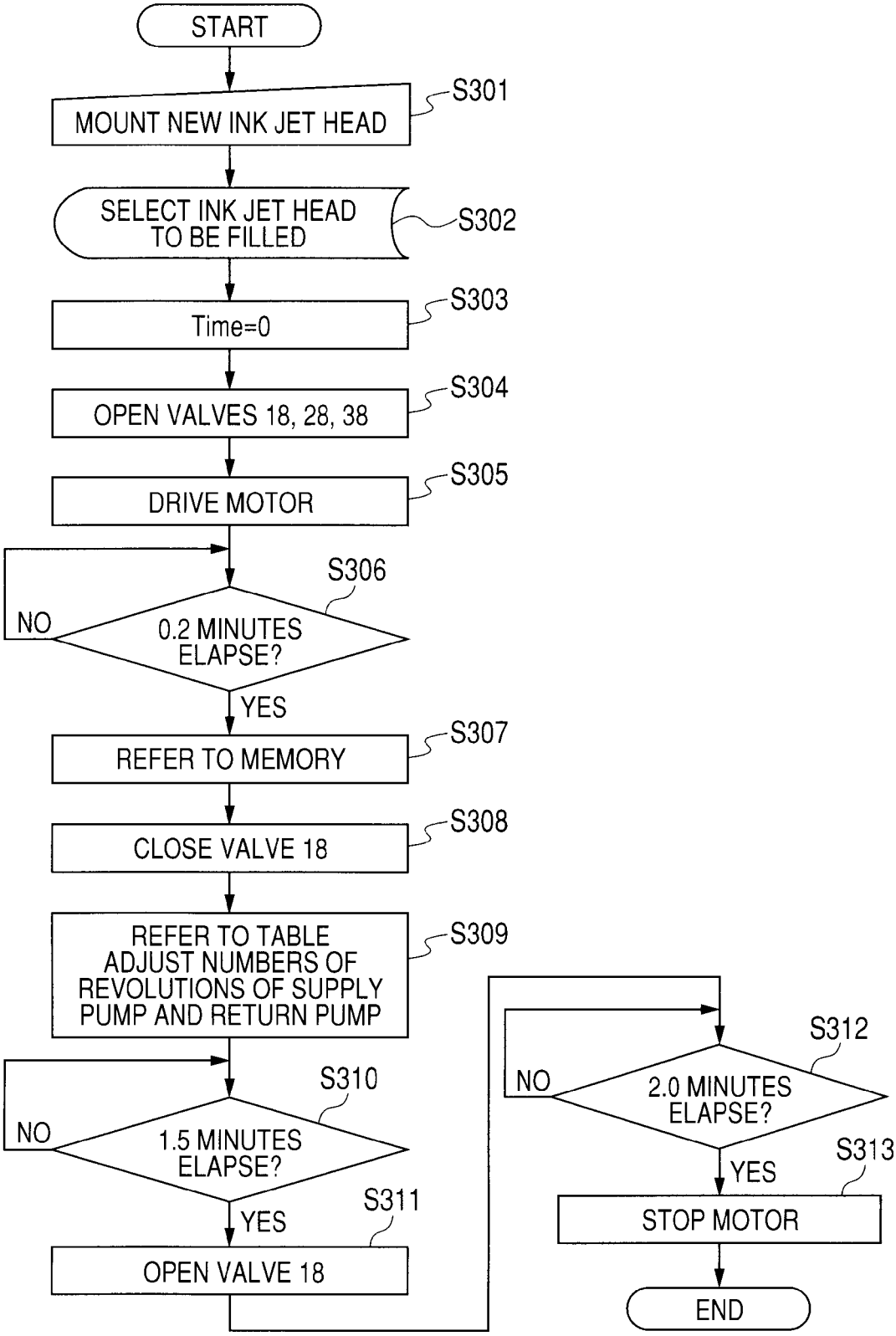
FIG. 13 is a control flowchart of the sixth embodiment.
Figure 14:
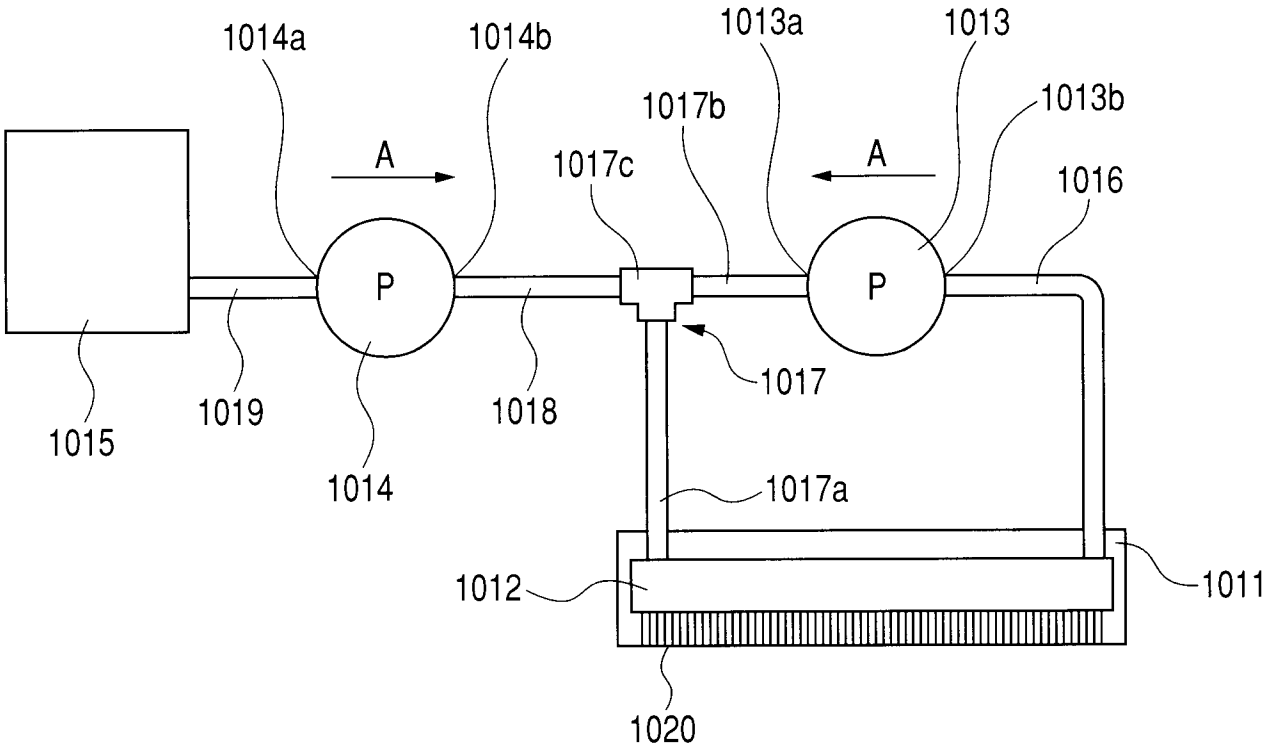
FIG. 14 is a diagram for describing known system.

FIG. 13 is a control flowchart of the embodiment 6. The operation at the time when one ink jet head is newly mounted and the corresponding ink is initially filled will now be described with reference to FIG. 13.

First, the new ink jet head 12 is mounted to the recording apparatus 1 in step S301. Subsequently, the ink jet head to be filled with the ink is selected in step S302. Specifically, data for specifying the selected ink jet head 12 is input into the RAM 202 by using an input device such as a ten-key keypad.

At this time, about 2 ml of physical distribution ink, for example, has been stored in the liquid chamber 11 and the nozzle of the exchanged ink jet head 12 in order to prevent the ink from drying out. The ink has almost fully been stored in each of the liquid chambers 21 and 31 of the ink jet heads 22 and 32 which are not exchanged.

Subsequently, after the timer is set to 0 minutes in step S303, the on/off valves 18, 28, and 38 are opened.

The nozzle surface of each of the ink jet heads 12, 22, and 32 is set to a position which is higher by 150 mm than the bottom surface of each of the ink tanks 13, 23, and 33. Therefore, from the ink parallel supply paths 17, 27, and 37 to the supply ports 14, 24, and 34 through the ink supply paths 15, 25, and 35, there is caused an equilibrium state by the height difference.

Subsequently, when the driving motor 97 is driven in step S305, the return pumps 41, 51, and 61 and the supply pumps 16, 26, and 36 are driven through the driving axis 98. The driving motor 97 is driven at a rotational speed of 2000 pps so that the flow rates of the return pumps 41, 51, and 61 and the supply pumps 16, 26, and 36 are equal to 10 ml/min.

At this time, the physical distribution ink and the air in the ink jet head 12 flow out of the return port 19 to the ink return path 40.

In the ink jet heads 22 and 32, the ink stored in the liquid chambers 21 and 31 flows from the return ports 29 and 39 into the corresponding ink tanks 23 and 33 through the ink return paths 50 and 60.

The ink stored in the ink tanks 23 and 33 passes through the on/off valves 28 and 38, the ink parallel supply paths 27 and 37, and the supply ports 24 and 34 and is supplied to the liquid chambers 21 and 31 of the ink jet heads 22 and 32, so that the ink jet heads enter what is called an ink circulating state.

Subsequently, if it is determined in step S306 that the time of 0.2 minutes of the timer has elapsed, the data (stored in the RAM 202) of the ink jet head to be filled with the ink is referred to in step S307. In step S308, the on/off valve corresponding to the ink jet head which is filled with the ink and has been specified by referring to the memory is closed. For example, if the ink jet head 12 was exchanged, the on/off valve 18 is turned off and closed.

If the on/off valve 18 was open, a part of the ink fed out by the supply pump 16 has flowed in the ink parallel supply path 17 and has been returned to the ink tank 13. By closing the on/off valve 18, the ink flowed in the ink parallel supply path 17 is stopped and all of the ink fed out by the supply pump 16 is sent to the ink jet head 12. At this time, the ink of the flow rate of 10 ml/min is supplied with a pressure from the ink tank 13 to the liquid chamber 11 of the ink jet head 12 through the supply port 14.

By such a pressurized supply, the ink is gradually filled from the side near the supply port 14 toward the return port 19 side and each nozzle forms a meniscus with the ink.

The air bubble in the liquid chamber 11 is gradually expelled under the negative pressure from the return pump (and the positive pressure of the supply pump) and flows to the return port 19 side.

At this time, when the pressure in the liquid chamber 11 exceeds the meniscus-holding force (for example, about 5 kPa) of the nozzle, the ink drops from the nozzle. When the pressure in the liquid chamber 11 exceeds the meniscus-holding force, the physical distribution ink is also expelled from the nozzle.

Since the on/off valves 28 and 38 are held in the open state, a part of the ink which is supplied from the ink tanks 23 and 33 by the supply pumps 26 and 36 is returned to the ink tanks 23 and 33 through the ink parallel supply paths 27 and 37.

Also in this instance, the ink jet heads 22 and 32 enter the ink circulating state where the air is not substantially sucked from the nozzles and the ink is not substantially leaked out of the nozzles.

Subsequently, rotational speeds of the supply pump and the return pump are adjusted with reference to the table in step S309.

If it is decided in step S310 that the time of 1.5 minutes of the timer has elapsed, the processing routine advances to step S311 and the on/off valve 18 is opened.

The ink containing the bubble in the liquid chamber 11 of the ink jet head 12 is returned from the return port 19 to the ink tank 13 through the ink return path 40.

The ink jet heads 22 and 32 maintain the ink circulating state.

Subsequently, after the time of 2 minutes of the timer have elapsed (S312), the driving motor 97 is stopped (S313), the return pumps 41, 51, and 61 and the supply pumps 16, 26, and 36 are stopped, and the initial ink filling operation of the liquid chamber 11 of the ink jet head 12 is finished.

As mentioned above, by the control of the on/off valve, the specific ink jet head is selected and the ink initial filling operation of only such an ink jet head can be performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-311230, filed Dec. 5, 2008, and Japanese Patent Application No. 2009-232730, filed Oct. 6, 2009, which are hereby incorporated by reference herein in their entirety.

What is claimed is:

1. A recording apparatus comprising:

a recording head having a liquid chamber for storing liquid and at least one nozzle for discharging liquid;

a tank for storing liquid which is to be supplied to the recording head;

a liquid supply path for supplying liquid from the tank to the liquid chamber;

a supply pump provided in the liquid supply path;

a liquid return path for returning liquid from the liquid chamber to the tank;

a return pump provided in the liquid return path; and a control unit for controlling driving of the supply pump and the return pump, wherein, when liquid is initially to be introduced into the liquid chamber, the control unit is configured, in a first stage, to drive the return pump so as to cause a negative pressure state in the liquid chamber via the liquid return path between the liquid chamber and the tank, and in a second stage after the first stage, to drive the supply pump to supply liquid from the tank to the liquid chamber.

2. An apparatus according to claim 1, wherein the control unit is configured, in the second stage, to control the supply pump and the return pump so that a flow rate of the supply pump is larger than a flow rate of the return pump.

3. An apparatus according to claim 1, wherein the control unit is configured, in the second stage, to control the supply pump and the return pump such that the flow rate of liquid in the supply path is balanced with the flow rate of liquid in the return path such that pressure in the liquid chamber is balanced with a pressure exerted on liquid via the at least one nozzle.

4. An apparatus according to claim 1, further comprising:

a first filter provided at a return port where the liquid supply path is connected to the liquid chamber, the first filter characterized by a bubble point;

wherein in the first stage the return pump is driven so as to cause a negative pressure in the liquid return path that exceeds the bubble point of the first filter causing bubbles to flow out of the liquid chamber and through the liquid return path.

5. An apparatus according to claim 1, wherein during the second stage the control unit controls pressure in the liquid chamber such that the pressure in the liquid chamber does not exceed the meniscus-holding force of the at least one nozzle for discharging liquid.

6. An apparatus according to claim 1, wherein during the second stage the control unit controls driving of both the supply pump and the return pump such that pressure in the liquid chamber does not exceed the meniscus-holding force of the at least one nozzle for discharging liquid.

7. An apparatus according to claim 1, further comprising:

a filter provided at a supply port where the liquid supply path is connected to the liquid chamber, the filter being adapted to stop air bubbles from entering the liquid chamber; and a parallel supply path which is connected from the tank into the liquid supply path without passing through the supply pump, wherein, after the second stage, the control unit is configured, in a third stage, to drive the return pump in a reverse direction so as to pump liquid from the liquid chamber to the tank via the filter in the supply path.

8. An apparatus according to claim 7, further comprising a valve between the tank and the parallel supply path, wherein the control unit is configured to open the valve during the first stage and to close the valve during the second stage.

9. An apparatus according to claim 1, further comprising a return path pressure sensor configured to detect the pressure in the liquid return path on an upstream side of the return pump, wherein, after the first stage, when the return path pressure sensor detects a pressure lower than a first threshold value, the control unit is configured to drive the supply pump.

10. An apparatus according to claim 9, further comprising a supply path pressure sensor for detecting the pressure in the liquid supply path on a downstream side of the supply pump, wherein, after the second stage, when the supply path pressure sensor detects a pressure higher than a second threshold value, the control unit is configured to stop the supply pump.

11. A recording apparatus comprising:

a recording head having liquid chamber for storing a liquid and at least one nozzle for discharging liquid;

a tank for storing liquid which is to be supplied to the recording head;

a liquid supply path for supplying liquid from the tank to the liquid chamber;

a supply pump provided in the liquid supply path;

a parallel supply path which is connected from the tank into the liquid supply path without passing through the supply pump;

a valve arranged between the tank and the parallel supply path, the valve being configured to switch the tank into either a first state where the tank and the parallel path are connected or a second state where the tank and the parallel path are not connected;

a liquid return path for returning liquid from the liquid chamber to the tank;

a return pump provided in the liquid return path; and a control unit for controlling driving of the supply pump, the return pump and the valve;

wherein, when liquid is initially to be introduced into the liquid chamber, the control unit is configured, in a first stage, to make the valve into the first state and drive the return pump so as to cause a negative pressure state in the liquid chamber via the liquid return path between the liquid chamber and the tank, and in a second stage after the first stage, to switch the valve into the second state and drive the supply pump to supply liquid from the tank to the liquid chamber.

12. A recording system comprising a plurality of recording apparatuses comprising:

a first recording apparatus comprising:

a first recording head having a first liquid chamber for storing a first liquid and at least one nozzle for discharging liquid;

a first tank for storing the first liquid which is to be supplied to the first recording head;

a first liquid supply path for supplying the first liquid from the first tank to the first liquid chamber;

a first supply pump provided in the first liquid supply path;

a first liquid return path for returning the first liquid from the first liquid chamber to the first tank; and a first return pump provided in the first liquid return path; and a second recording apparatus comprising:

a second recording head having a second liquid chamber for storing a second liquid and at least one nozzle for discharging liquid;

a second tank for storing the second liquid which is to be supplied to the second recording head;

a second liquid supply path for supplying the second liquid from the second tank to the second liquid chamber;

a second supply pump provided in the second liquid supply path;

a second liquid return path for returning the second liquid from the second liquid chamber to the second tank; and a second return pump provided in the second liquid return path;

a control unit for controlling driving of the supply pumps and the return pumps, wherein, when liquid is initially to be introduced into the liquid chambers, the control unit is configured, in a first stage, to drive the return pumps so as to cause a negative pressure state in the liquid chambers via the liquid return paths between the liquid chambers and the tanks, and in a second stage after the first stage, to drive the supply pump to supply liquid from the tanks to the liquid chambers, and a first driver motor for driving a group of pumps selected from:

a supply group of pumps comprising the first and second supply pumps; and a return group of pumps comprising the first and second return pumps.

13. An recording system according to claim 12, further comprising:

a second driver motor for driving a pump selected from the group of pumps not driven by the first driver motor; and a third driver motor for driving a pump selected from the group of pumps not driven by the first driver motor and not driven by the second driver mother.

* * * * *